US005584434A

United States Patent [19]

Lipson

[11] Patent Number: 5,584,434

[45] Date of Patent: Dec. 17, 1996

[54] DRINKING STRAW HAVING A CAGE FOR CONTAINING AN OBJECT THEREIN

[76] Inventor: Erik Lipson, 1530 Locust St., #15F, Philadelphia, Pa. 19102

[21] Appl. No.: 377,851

[22] Filed: Jan. 25, 1995

[51] Int. Cl.[6] ..... A47G 21/18

[52] U.S. Cl. ..... 239/33; 446/74; 446/267

[58] Field of Search ..... 239/33, 24, 16; 446/267, 74; 215/229

[56] References Cited

U.S. PATENT DOCUMENTS 3,517,884 6/1970 Horvath ..... 239/33
4,576,336 3/1986 Cohen ..... 239/33

FOREIGN PATENT DOCUMENTS 3407733 9/1985 Germany .

*Primary Examiner*—Lesley D. Morris
*Attorney, Agent, or Firm*—Gifford, Krass, Groh, Sprinkle, Patmore, Anderson & Citkowski, P.C.

[57] ABSTRACT

A novelty drinking straw in the form of a drinking tube having a three dimensional cage for containing a prize object therein. The straw includes first and second linear end portions, a three dimensional, prize containing cage, and means for retaining the prize in the cage. The cage may be configured so that the prize cannot slip out, or it may include a linear extending portion passing through the cage and an apertured prize contained therein. The novelty straw and contained prize object find particular utility as giveaway premiums and favors.

12 Claims, 2 Drawing Sheets

DRINKING STRAW HAVING A CAGE FOR CONTAINING AN OBJECT THEREIN

FIELD OF THE INVENTION

The present invention relates to the field of novelty drinking straws and, more particularly, to such a drinking straw having a portion defining a three dimensional cage for containment of a novelty prize therein.

BACKGROUND OF THE INVENTION

Novelty drinking straws are becoming more and more popular every year. Part of their popularity is due to the fact that they are inexpensive to manufacture and easy to package, thus being a desirable product to serve as a "premium" given away at such establishments as fast food restaurants, or to serve as favors at children's parties. Many of these novelty drinking straws include drinking passages which are in the form of loops, spirals, flowers, stick figures, eyeglasses, etc. Some examples of patents disclosing such novelty drinking straws include U.S. Pat. Nos. 3,517,884 and 4,576,336, as well as German Published Application 3407733. These references all disclose drinking straws having a plurality of spirally wound loops connecting the mouthpiece and the end which is inserted into the liquid to be drunk.

In particular, U.S. Pat. No. 3,517,894 discloses one such novelty straw including a plurality of spirally wound loops connecting two end portions, each having a constricted internal diameter. One or more small objects, such as beads, are placed within the coils of the spiral portion. Due to the constricted internal diameters of the ends, fluid may pass therethrough, but the small objects are retained inside the straw.

In the case of U.S. Pat. No. 4,576,336, a plurality of coils are spirally wound around a drinking glass, with the mouthpiece projecting from outside the glass, and the other end being submerged inside the glass. In this way, the straw engages the glass so the two can be picked up simultaneously.

Furthermore, applicant in the invention of U.S. Pat. No. 5,427,315, which discloses a drinking straw having an insert and including a continuous passage hollow tube with two ends which is interrupted by one or more loops. The loops are oriented parallel to the ends of the passageway. One end of the passageway is connected to the looped portion by a transversely extending portion. The straw also includes a planar insert having an aperture or notch for engagement with the transverse portion so that the insert may be attached to the straw. However, due to the arrangement and orientation of the spirals, the novelty drinking straw of the disclosed patent is most advantageously used in combination with planar configured novelty items (printed pasteboard, cardboard or plastic), thus somewhat restricting its usefulness as an entertainment device.

Clearly, there is a need for a novelty drinking straw which may be used in combination with a variety of toys and other amusement devices so as to create an item of great appeal to children. There is also a need for such a novelty drinking straw in combination with a retained object wherein the object retained therein remains intact, and easily removable from the straw. Finally, there is a need for such a drinking straw which is inexpensive and easy enough to manufacture so that it may be used as a free, promotional item.

SUMMARY OF THE INVENTION

The present invention has been designed to overcome the deficiencies in the prior art noted above. It is a novelty drinking straw for use in combination with a prize object, such as a small ball, a two-part hollow plastic egg having a token therein, a rolled up coupon, etc. The drinking straw of the present invention includes a drinking tube defining a hollow, continuous flow passage and having first and second linearly extending end portions. One of the end portions defines a mouthpiece. Preferably, the drinking tube is formed of a resilient, translucent or transparent plastic material.

In an intermediate portion between said first and second end portions, the drinking tube defines a three dimensional cage including an interior volume for containing a prize object which is dimensioned to fit inside the interior volume. For example, the three dimensional cage may be configured as a cylindrical volume formed by a plurality of coils which are spirally wound around an axis defined by or parallel to one of the first or second linear end portions. That is, the coils are disposed roughly transverse the linear axis of the straw so as to define a three-dimensional interior volume for containing the prize object.

In another embodiment, the cage may define a roughly parallepiped interior volume and be formed of a plurality of linear portions which wind back and forth and up and down. A prize object such as a zoo animal could be placed inside the "bars" created by this embodiment.

The invention also includes means for retaining the prize object inside the interior volume. In one preferred embodiment, the cage is comprised of loops which are graduated in the sizes of their circumferences, from a largest loop disposed proximate the middle of the cage, with the coils gradually decreasing in circumferential size towards smallest circumference coils displaced at either end of the cage. Thus, the interior volume has its largest diameter proximate its middle portion, and gradually tapers down in diameter towards its ends. Thus, if the prize object is dimensioned so that its diameter is smaller than the diameter of the middle portion of the cage, but larger than the end diameters, it will be retained within the egg shaped cage. Alternatively, the retaining means may be formed by horizontally oriented windings which extend along the top and bottom of the cage to enclose it.

Of course, since the cage is composed of windings or coils, the windings or coils may be displaced linearly with respect to each other, so that the prize object may easily be removed from the cage by passing it between the displaced windings. This removability feature is enhanced if the novelty straw of the present invention is formed of a resilient material, such as plastic. The user may simply grip the first and second ends and pull them in opposite directions, thus spreading the windings and allowing removal of the prize object, or, alternatively, may bend the two ends toward each other so as to fan out the windings, thus enabling retrieval of the prize object.

In another preferred embodiment, the cage comprises a plurality of spirally wound coils which are approximately of equal size to define a roughly cylindrical interior volume. In this embodiment, the means for retaining an object inside the cylindrical interior volume comprises a linear extension of one of the two end portions which extends through the helical cage, itself and joins the cage to the one end portion. Typically, a prize object used with this embodiment has a through passage so that the linear extension of the drinking tube will pass through the object, itself, thus helping to retain it within the cage. Retention of such an object is assisted by the resiliency of the drinking tube which causes the coils to grip the object, thus preventing it from slipping down the tube. This embodiment of the present invention is particularly useful if the prize object is a rolled up piece of paper or cardboard having a coupon, picture, game, or other message printed thereon. The piece of paper or cardboard is simply rolled into a tube, slipped over one end of the straw, and slid into the helical cage.

BRIEF DESCRIPTION OF THE DRAWINGS

The following detailed description is best understood with reference to the following drawings in which.

DETAILED DESCRIPTION OF THE PREFERRED EMBODIMENTS

Figure 1:
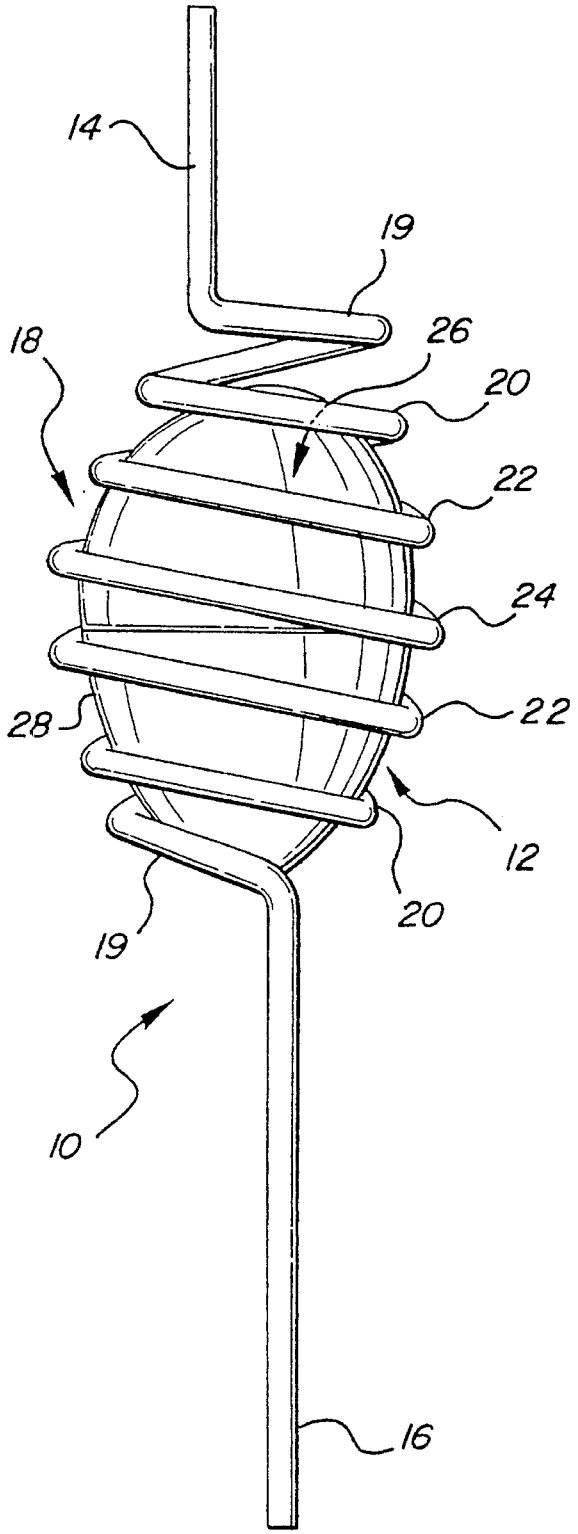
FIG. 1 is a perspective view of one embodiment of the novelty drinking straw of the present invention.
Figure 3:
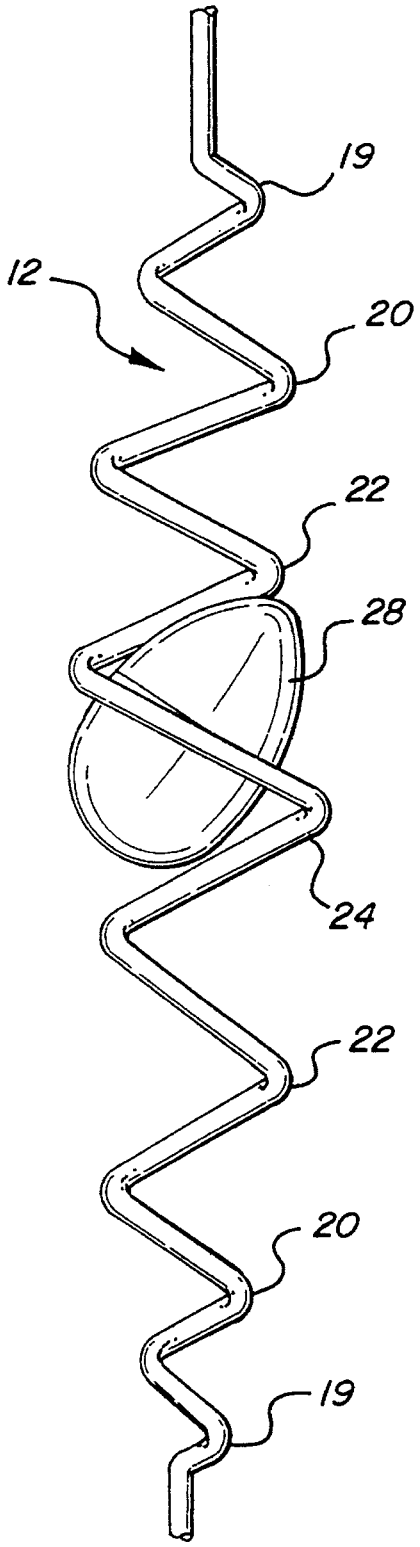
FIG. 3 is a partial perspective view of the embodiment of FIG. 1 showing the coils spread apart to enable retrieval of the prize object.

Throughout the following detailed description, like numerals are used to reference the same element of the present invention shown in multiple figures thereof. Referring now to the drawings, and in particular to FIGS. 1 and 3, there is shown a novelty drinking straw 10 including a drinking tube 12 defining a hollow, continuous flow passage therethrough. The tube includes first 14 and second 16 linearly extending end portions. In the depicted embodiment, it is contemplated that the first linear end portion 14 will be used as a mouthpiece and second end portion 16 will be submerged in the liquid to be drunk.

A helical cage 18 is disposed intermediate the first and second end portions 14, 16. It includes a plurality of spirally wound coils 19, 20, 22, 24. As can readily be seen by examining FIG. 1, the coils gradually increase in size from either end coil 19 toward the middle coil 24. Thus, the coils 19–24 collectively define an interior volume 26 which is broader in its middle than it is at either end.

An egg shaped prize object 28 is shown in place inside helical coil 18. It has a circumference in at least one direction that is greater than the internal circumference of end coils 19 but less than the internal circumference of middle coil 24. Thus, due to the described configuration of interior volume 26, prize object 28 is retained therein.

It is contemplated that the embodiment of the present invention depicted in FIG. 1 may be given away as a prize or promotional item, or sold for a small sum. To that end, its desirability as a prize is enhanced if the prize object 28 is of the familiar hollow, two part form so that it may contain yet another toy or surprise therein. Thus, upon receiving the novelty straw of the present invention, a child may enjoy it in several ways: the drinking tube 12 may be used by itself or with the prize object 28 still retained therein, and the child may enjoy watching passage of liquid through the coils 19–24. Also, the child may remove the prize object 28 from the helical cage. The child may then open the "egg" to discover the surprise therein.

FIG. 3 depicts one way in which the cage 18 may be opened so that the prize object 28 can be removed. In this case, the two end portions 14, 16 have been linearly displaced in opposite directions with respect to each other so as to spread apart the coils 19–24. In this way, the prize object 28 may be easily removed from the cage 18 by passing it between the spread apart coils. Another way (not depicted) would be to bend the straw so that the two end portions 14, 16 lie adjacent each other, thus causing the coils 19–24 to fan out and permit removal of the prize object 28.

Of course, a different kind of prize object than the hollow egg depicted may be placed inside the helical cage 18. For example, a small toy ball may be placed therein, a plastic figurine or action figure, a toy vehicle, etc. Thus, the straw of the present invention is not limited to the depicted straw/prize object combination, but may be used to contain a staggering variety of toys and other items particularly appealing to children.

Figure 2:
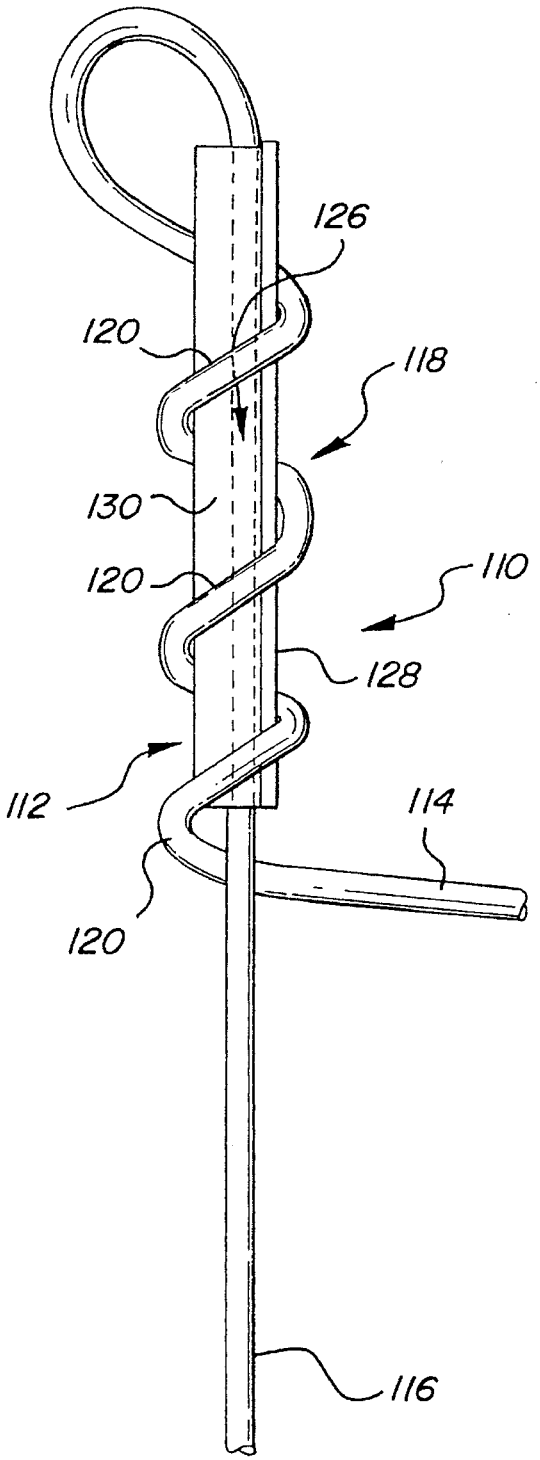
FIG. 2 is a perspective view of a second embodiment of the drinking straw of the present invention.

An alternative embodiment 110 of the straw of the present invention is depicted in FIG. 2. Like the previously described embodiment, straw 110 also includes a drinking tube 112 which defines a hollow, continuous flow passage. It further includes first 114 and second 116 end linear portions, although it should be noted that, in this embodiment, the two end portions 114, 116 are oriented perpendicular, rather than parallel, to each other. The embodiment of FIG. 2 also includes a helical cage 118 comprised of a plurality of spirally wound coils 120 which are approximately equal sized, thus defining a roughly cylindrical interior volume 126.

Extending linearly from second end portion 116 is a linear extension 130 (shown in phantom). It connects second end portion 116 with helical cage 118. Furthermore, it passes through prize object 128 which, in the depicted embodiment, is in the form of a rolled up piece of paper, with linear extension 130 passing through the hollow middle of the paper roll 128.

Figure 4:
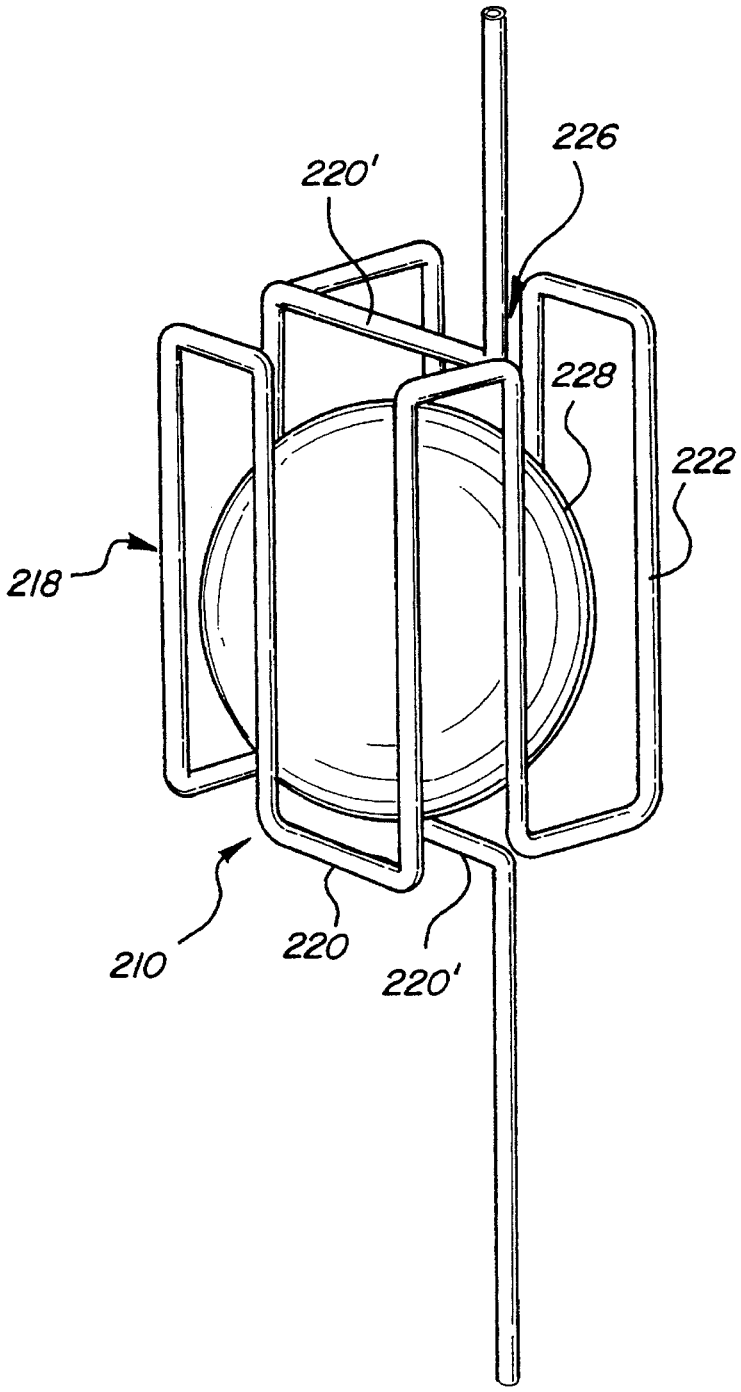
FIG. 4 is a perspective view of yet another embodiment of the drinking straw of the present invention showing a parallepiped cage.

Yet another embodiment 210 of the novelty drinking straw is shown in FIG. 4. In this embodiment, the three-dimensional cage 218 defines a roughly parallepiped interior volume 226. The cage 218 is formed of a plurality of horizontally and vertically oriented windings 220,222, respectively, which together define the flat sides of the cage 218. Two of the horizontal windings 220' are disposed on the top and bottom of the cage 218 to enclose volume 226 and retain a prize object in the form of a ball 228 therein.

Preferably, the novelty straw of the present invention is fabricated from a resilient plastic, such as polyethylene tubing. Thus, the resilient coils 120 will grip the paper roll 128 to assist in securing it in the straw 110. In this embodiment, the object may be removed from the straw by simply slipping the paper roll 128 down the extended portion 130 and off second end portion 116.

Again, the embodiment depicted in FIG. 2 is not limited to a combination novelty straw and paper roll; the prize object may take a number of other forms as long as it includes a through passage so that the extended portion 130 may be passed thereto to secure the prize object to the straw.

Thus, a novelty drinking straw including a drinking tube having a three dimensional cage to enclose a prize object has been depicted and described with reference to certain embodiments thereof. Doubtless, one skilled in the art, having had the benefit of the teachings of the present invention, may configure the drinking tube somewhat differently and may use the straw with prize objects differing from those depicted without departing from the scope of the present invention. For example, instead of defining a cylindrical, egg shaped or parallepiped volume, the three dimensional cage of the straw may define volumes of other and more complex configurations. Thus, it is the claims appended hereto, and all reasonable equivalents thereof, rather than the depicted embodiments and exemplifications, which define the true scope of the present invention.

I claim:

1. A novelty drinking straw comprising:

a drinking tube defining a hollow, continuous flow passage and including first and second linearly extending end portions, one of said first and second end portions defining a mouthpiece;

a three dimensional cage formed by said flow passage and disposed therealong intermediate said first and second end portions, said cage defining an interior volume configured to retain a prize object entirely therein; and means formed by said passageway for retaining said object within said interior volume.

2. The drinking straw of claim 1 wherein one of said first and second end portions lies parallel to an axis and said cage is formed of a plurality of coils wound spirally around said axis.

3. The straw of claim 2 wherein said plurality of coils each has a circumference, said coils being graduated in circumference from a largest circumference coil proximate a middle portion of said cage to a smallest circumference coil disposed proximate each end of said cage to form said means for retaining said object therein.

4. The straw of claim 1 wherein said cage is formed of a plurality of horizontally and vertically extending windings to define a parallepiped interior volume.

5. The straw of claim 1 wherein said drinking tube is formed of a resilient material.

6. A combination novelty drinking straw and prize object contained therein, said combination comprising:

a resilient drinking tube defining a hollow, continuous flow passage and including first and second linearly extending end portions, one of said first and second end portions defining a mouthpiece a helical cage having first and second ends and a middle portion medial thereof, said cage being formed by said flow passage and disposed therealong intermediate said first and second end portions, said cage defining an interior volume and being formed by a plurality of coils wound spirally around said volume, said plurality of coils each having a circumference and being graduated in circumference from a largest circumference coil proximate said middle portion of said cage to a smallest circumference coil disposed proximate each of said first and second end of said cage; and a novelty prize object disposed in said interior volume, said prize being dimensioned so as to be normally retained within said interior volume and to be removable from said interior volume when adjacent pairs of coils of said cage are linearly displaced away from each other so that said object prize is passable therebetween.

7. The straw of claim 6 wherein the object has a circumference in at least one direction sized smaller than said largest coil circumference and larger than said smallest coil circumferences.

8. The straw of claim 6 wherein said drinking tube is formed of a resilient material.

9. A combination novelty drinking straw and prize object contained therein, said combination comprising:

a drinking tube defining a hollow, continuous flow passage and including first and second linearly extending end portions, one of said first and second end portions defining a mouthpiece and lying parallel an axis;

a three dimensional cage having first and second ends and a middle portion medial thereof, said cage being formed by said flow passage and disposed therealong intermediate said first and second end portions, said cage defining an interior volume for containing a prize object dimensioned to fit therein, said cage being formed of a plurality of coils wound spirally around said axis, said coils being graduated in circumference from a largest circumference coil proximate said middle portion of said cage to a smallest circumference coil disposed proximate each of said first and second ends of said cage to form means for retaining said object therein, wherein the prize object has a circumference in at least one direction sized smaller than said largest coil circumference and larger than said smallest coil circumference.

10. A novelty drinking straw comprising:

a drinking tube defining a hollow, continuous flow passage and including first and second linearly extending end portions, one of said first and second end portions defining a mouthpiece;

a three dimensional cage formed by said flow passage and disposed therealong intermediate said first and second end portions, said cage being formed of a plurality of horizontally and vertically extending windings to define a parallepiped interior volume or containing a prize object dimensioned to fit therein; and means formed by said passageway or retaining said object within said interior volume.

11. A combination novelty drinking straw and prize object contained therein, said combination comprising:

a drinking tube defining a hollow, continuous flow passage and including first and second linearly extending end portions, one of said first and second end portions defining a mouthpiece;

a three dimensional cage formed by said flow passage and disposed therealong intermediate said first and second end portions, said cage defining an interior volume for containing a prize object having means defining a passage formed therethrough and dimensioned to fit in said cage; and means formed by said passageway tier retaining said object within said interior volume comprising a linear extension of said one end portion which extends along said axis through said helical cage for extension through said passage of said prize object when said prize object is placed within said interior volume.

12. The straw of claim 11 wherein said coils are substantially uniform in size.

* * * * *